US010297199B2

(12) United States Patent
Cai

(10) Patent No.: US 10,297,199 B2
(45) Date of Patent: May 21, 2019

(54) AMOLED PIXEL DRIVING CIRCUIT AND PIXEL DRIVING METHOD

(71) Applicant: Shenzhen China Star Optoelectronics Technology Co., Ltd., Shenzhen (CN)

(72) Inventor: Yuying Cai, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 144 days.

(21) Appl. No.: 15/106,835

(22) PCT Filed: May 13, 2016

(86) PCT No.: PCT/CN2016/082126
§ 371 (c)(1),
(2) Date: Jun. 21, 2016

(87) PCT Pub. No.: WO2017/177501
PCT Pub. Date: Oct. 19, 2017

(65) Prior Publication Data

US 2018/0082636 A1 Mar. 22, 2018

(30) Foreign Application Priority Data

Apr. 12, 2016 (CN) ..... 2016 1 0225567

(51) Int. Cl.
*G09G 5/00* (2006.01)
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0426* (2013.01); (Continued)

(58) Field of Classification Search
CPC ..... G09G 3/32; G09G 3/3233; G09G 3/3258; G09G 2300/0819; G09G 2300/0852; (Continued)

(56) References Cited

U.S. PATENT DOCUMENTS

2008/0224965 A1* 9/2008 Kim ..... G09G 3/3233 345/76
2011/0084947 A1 4/2011 Chung
2015/0053947 A1* 2/2015 Qing ..... G09G 3/3233 257/40

FOREIGN PATENT DOCUMENTS

CN 104064139 A 9/2014

* cited by examiner

*Primary Examiner* — Stacy Khoo
(74) *Attorney, Agent, or Firm* — Leong C. Lei

(57) ABSTRACT

Disclosed are an AMOLED pixel driving circuit and a pixel driving method. The AMOLED pixel driving circuit utilizes the 4T2C structure, and comprises: a first thin film transistor (T1), a second thin film transistor (T2), a third thin film transistor (T3), a fourth thin film transistor (T4), a first capacitor (C1), a second capacitor (C2) and an organic light emitting diode (D1); the nth scan signal (SCAN(n)) and the n+1th scan signal (SCAN(n+1)) are combined with each other, and correspond to a threshold voltage sensing stage, a holding stage, a programming stage and a drive stage one after another. In comparison with the pixel driving circuit of the 5T2C structure, the corresponding thin film transistor is controlled merely with arranging the scan signal. There will be the compensation function, and the amount of the control signals can be decreased, and the circuit structure is simplified and the cost is decreased.

11 Claims, 9 Drawing Sheets

(52) U.S. Cl.
CPC ..... *G09G 2300/0819* (2013.01); *G09G 2300/0852* (2013.01); *G09G 2300/0861* (2013.01); *G09G 2300/0871* (2013.01); *G09G 2310/0208* (2013.01); *G09G 2310/0262* (2013.01); *G09G 2320/0233* (2013.01); *G09G 2320/043* (2013.01)

(58) Field of Classification Search
CPC ..... G09G 2300/0861; G09G 2310/061; G09G 2320/0233; G09G 2320/045; G09G 2330/02
See application file for complete search history.

AMOLED PIXEL DRIVING CIRCUIT AND PIXEL DRIVING METHOD

FIELD OF THE INVENTION

The present invention relates to an OLED display technology field, and more particularly to an AMOLED pixel driving circuit and a pixel driving method.

BACKGROUND OF THE INVENTION

The Organic Light Emitting Display (OLED) possesses many outstanding properties of self-illumination, low driving voltage, high luminescence efficiency, short response time, high clarity and contrast, near 180° view angle, wide range of working temperature, applicability of flexible display and large scale full color display. The OLED is considered as the most potential display device.

The OLED can be categorized into two major types according to the driving methods, which are the Passive Matrix OLED (PMOLED) and the Active Matrix OLED (AMOLED), i.e. two types of the direct addressing and the Thin Film Transistor (TFT) matrix addressing. The AMOLED comprises pixels arranged in array and belongs to active display type, which has high lighting efficiency and is generally utilized for the large scale display devices of high resolution.

The AMOLED is a current driving element. When the electrical current flows through the organic light emitting diode, the organic light emitting diode emits light, and the brightness is determined according to the current flowing through the organic light emitting diode itself. Most of the present Integrated Circuits (IC) only transmit voltage signals. Therefore, the AMOLED pixel driving circuit needs to accomplish the task of converting the voltage signals into the current signals. The traditional AMOLED pixel driving circuit is generally the 2T1C, i.e. the structure of two thin film transistors plus one capacitor to convert the voltage into the current. However, the threshold voltage of the traditional 2T1C pixel driving circuit will drift along with the working times. Thus, it results in that the luminescence of the OLED is unstable and the nonuniform luminescence and uneven brightness among the respective pixels.

The main method of solving the AMOLED uneven brightness is to improve the pixel driving circuit, and to add the compensation function to make the influence of the threshold voltage variation of the drive thin film transistor to the current flowing through the organic light emitting diode be smaller.

As shown in FIG. 1, which shows an AMOLED pixel driving circuit according to prior art, The AMOLED pixel driving circuit has the 5T2C structure, i.e. the structure of five thin film transistors plus two capacitors, comprising: a first thin film transistor T10, a second thin film transistor T20, a third thin film transistor T30, a fourth thin film transistor T40, a fifth thin film transistor T50, a first capacitor C10, a second capacitor C20 and an organic light emitting diode D10, and all the respective thin film transistors are P type thin film transistors. Specifically, the first thin film transistor T10 is a drive thin film transistor, and a gate thereof is electrically coupled to one end of the first capacitor C10 through a first node A0, and a source is electrically coupled to a power source positive voltage VDD, and a drain is electrically coupled to a source of a fifth thin film transistor T50; a gate of the second thin film transistor T20 receives a scan signal SCAN, and a source receives a data signal data, and a drain is electrically coupled to the other end of the first capacitor C10 through a second node B0; a gate of the third thin film transistor T30 receives a light emitting control signal EM, and a source receives a reference voltage Vref, and a drain is electrically coupled to the second node B0; a gate of the fourth thin film transistor T40 receives the scan signal SCAN, and a source is electrically coupled to the first node A0, and a drain is electrically coupled to the drain of the first thin film transistor T10 and a source of the fifth thin film transistor T50; a gate of the fifth thin film transistor T50 receives the light emitting control signal EM, and a source is electrically coupled to the drain of the first thin film transistor T10 and the drain of the fourth thin film transistor T40, and a drain is electrically coupled to an anode of the organic light emitting diode D10; the one end of the first capacitor C10 is electrically coupled to the first node A0, and the other end is electrically coupled to the second node B0; one end of the second capacitor C20 is electrically coupled to the first node A0, and the other end is electrically coupled to the power source positive voltage VDD; the anode of the organic light emitting diode D10 is electrically coupled to the drain of the fifth thin film transistor T50, and a cathode is electrically coupled to a power source negative voltage VSS.

FIG. 2 is a sequence diagram of the AMOLED pixel driving circuit of the 5T2C structure according to prior art as shown in FIG. 1, and the working process of the AMOLED pixel driving circuit can be divided into four stages according to the sequence: an initializing stage 10, a threshold voltage sampling stage 20, a holding stage 30 and a drive stage 40. With combination of FIG. 2 and FIG. 3, in the initializing stage 10, the scan signal SCAN provides low voltage level, and the second thin film transistor T20 and the fourth thin film transistor T40 controlled by the scan signal SCAN are activated, and the light emitting control signal EM provides low voltage level, and the third thin film transistor T30 and the fifth thin film transistor T50 controlled by the light emitting control signal EM are activated, and the data signal data is transmitted to the second node B0 through the second thin film transistor T20, and charges the first capacitor C10 to make the voltage of the second node B0 to be the data signal voltage $V_{data}$, and in this stage, both the fourth thin film transistor T40 and the fifth thin film transistor T50 are activated, and the voltage of the first node A0, i.e. the gate voltage of the first thin film transistor T10 $Vg=V_{OLED}$, and $V_{OLED}$ is the anode voltage of the organic light emitting diode D10. With combination of FIG. 2 and FIG. 4, in the threshold voltage sampling stage 20, the scan signal SCAN still provides low voltage level, and the light emitting control signal EM is raised from low voltage level to the high voltage level, and the third thin film transistor T30 and the fifth thin film transistor T50 are deactivated, and the voltage of the first node A0, i.e. the gate voltage Vg of the first thin film transistor T10 is changed to be VDD−Vth, and Vth is the threshold voltage of the first thin film transistor T10. With combination of FIG. 2 and FIG. 5, in the holding stage 30, the scan signal SCAN is raised from low voltage level to the high voltage level, and the light emitting control signal EM is kept to be high voltage level, and the second thin film transistor T20 and the fourth thin film transistor T40 are deactivated, and under the coupling function of the first capacitor C10 and the second capacitor C20, the voltages of the first node A0 and the second node B0 are raise with ΔV, and correspondingly, the gate voltage of the first thin film transistor T10 is Vg=VDD−Vth+ΔV. With combination of FIG. 2 and FIG. 6, in the drive stage 40, the light emitting control signal EM is dropped from high voltage level to the low voltage level, and the scan signal SCAN remains to be high voltage level, and the third thin film transistor T30 and the fifth thin film transistor T50 are activated, again, and the organic light emitting diode D10 starts to emit light, and then the voltage of the first node A0, i.e. the gate voltage of the first thin film transistor T10 is Vg=VDD−Vth+ΔV+Vref−Vdata, and the reference voltage Vref makes the voltage of the second node B0 drop to Vref through the activated third thin film transistor T30, and the source voltage Vs of the first thin film transistor T10 is VDD the same in the respective stages, and in the drive stage, the gate-source voltage of the first thin film transistor T10 is Vgs=Vg−Vs=VDD−Vth+ΔV+Vref−Vdata−VDD. Furthermore, as known, the formula of calculating the current flowing through the organic light emitting diode as the drive thin film transistor is a P type thin film transistor is:

$$I_{OLED}=\tfrac{1}{2}\mathrm{Cox}(\mu W/L)(Vgs+\mathrm{Vth})^2$$

wherein $I_{OLED}$ is the current of the organic light emitting diode D10, μ is the carrier mobility of the drive thin film transistor, i.e. the first thin film transistor T10, and W and L respectively are the width and the length of the channel of the drive thin film transistor, i.e. the first thin film transistor T10, and Vgs is the gate-source voltage of the drive thin film transistor, i.e. the first thin film transistor T10, and Vth is the threshold voltage of the drive thin film transistor, i.e. the first thin film transistor T10.

Vgs=VDD−Vth+ΔV+Vref−Vdata−VDD is substituted into the current calculation formula, and then:

$$I_{OLED}=\tfrac{1}{2}\mathrm{Cox}(\mu W/L)(\Delta V+V\mathrm{ref}-V\mathrm{data})^2$$

Obviously, the current flowing through the organic light emitting diode D10 is irrelevant with the threshold voltage Vth of the first thin film transistor T10, and the present AMOLED pixel driving circuit realizes the compensation function.

However, the present AMOLED pixel driving circuit requires setting the two signals, the scan signal and the light emitting control signal to control the corresponding thin film transistors. The amount of the signal lines is increased to raise the loading of the control IC, which goes against the saving of the cost.

SUMMARY OF THE INVENTION

An objective of the present invention is to provide an AMOLED pixel driving circuit, which can decrease the amount of the control signals, and simplify the circuit structure and decrease the cost.

Another objective of the present invention is to provide a pixel driving method, which can decrease the amount of the control signals, and simplify the circuit structure and decrease the cost.

For realizing the aforesaid objectives, the present invention first provides an AMOLED pixel driving circuit, comprising: a first thin film transistor, a second thin film transistor, a third thin film transistor, a fourth thin film transistor, a first capacitor, a second capacitor and an organic light emitting diode; all the respective thin film transistors are P type thin film transistors;

the first thin film transistor is a drive thin film transistor, and a gate thereof is electrically coupled to one end of the first capacitor through a first node, and a source is electrically coupled to a power source positive voltage, and a drain is electrically coupled to an anode of the organic light emitting diode;

a gate of the second thin film transistor receives a nth scan signal corresponded with a row where the pixel driving circuit is, and a source receives a data signal, and a drain is electrically coupled to the other end of the first capacitor through a second node;

a gate of the third thin film transistor receives a n+1 th scan signal corresponded with a next row of the row where the pixel driving circuit is, and a source is electrically coupled to the second node, and a drain is electrically coupled to a reference voltage;

a gate of the fourth thin film transistor receives the nth scan signal corresponded with the row where the pixel driving circuit is, and a source is electrically coupled to the first node, and a drain is electrically coupled to the anode of the organic light emitting diode;

the one end of the first capacitor is electrically coupled to the first node, and the other end is electrically coupled to the second node;

one end of the second capacitor is electrically coupled to the first node, and the other end is electrically coupled to the power source positive voltage;

the anode of the organic light emitting diode is electrically coupled to the drain of the first thin film transistor and the drain of the fourth thin film transistor, and a cathode is electrically coupled to a power source negative voltage.

The reference voltage is a constant voltage.

All of the first thin film transistor, the second thin film transistor, the third thin film transistor and the fourth thin film transistor are Low Temperature Poly-silicon thin film transistors, oxide semiconductor thin film transistors or amorphous silicon thin film transistors.

The scan signal is a pulse signal, and a falling edge of the n+1th scan signal is later than a rising edge of the nth scan signal.

The nth scan signal and the n+1th scan signal are combined with each other, and correspond to a threshold voltage sensing stage, a holding stage, a programming stage and a drive stage one after another;

in the threshold voltage sensing stage, the nth scan signal is low voltage level, and the n+1th scan signal is high voltage level;

in the holding stage, the nth scan signal is high voltage level, and the n+1th scan signal is high voltage level;

in the programming stage, the nth scan signal is high voltage level, and the n+1th scan signal is low voltage level;

in the drive stage, the nth scan signal is high voltage level, and the n+1th scan signal is high voltage level.

The present invention further provides an AMOLED pixel driving method, comprising steps of:

step 1, providing an AMOLED pixel driving circuit;

the AMOLED pixel driving circuit comprises: a first thin film transistor, a second thin film transistor, a third thin film transistor, a fourth thin film transistor, a first capacitor, a second capacitor and an organic light emitting diode; all the respective thin film transistors are P type thin film transistors;

the first thin film transistor is a drive thin film transistor, and a gate thereof is electrically coupled to one end of the first capacitor through a first node, and a source is electrically coupled to a power source positive voltage, and a drain is electrically coupled to an anode of the organic light emitting diode;

a gate of the second thin film transistor receives a nth scan signal corresponded with a row where the pixel driving circuit is, and a source receives a data signal, and a drain is electrically coupled to the other end of the first capacitor through a second node;

a gate of the third thin film transistor receives a n+1th scan signal corresponded with a next row of the row where the pixel driving circuit is, and a source is electrically coupled to the second node, and a drain is electrically coupled to a reference voltage;

a gate of the fourth thin film transistor receives the nth scan signal corresponded with the row where the pixel driving circuit is, and a source is electrically coupled to the first node, and a drain is electrically coupled to the anode of the organic light emitting diode;

the one end of the first capacitor is electrically coupled to the first node, and the other end is electrically coupled to the second node;

one end of the second capacitor is electrically coupled to the first node, and the other end is electrically coupled to the power source positive voltage;

the anode of the organic light emitting diode is electrically coupled to the drain of the first thin film transistor and the drain of the fourth thin film transistor, and a cathode is electrically coupled to a power source negative voltage;

step 2, entering a threshold voltage sensing stage;

the nth scan signal provides low voltage level, and the second thin film transistor and the fourth thin film transistor are activated, and the n+1th scan signal provides high voltage level, and third thin film transistor is deactivated; the data signal is transmitted to the second node, and the first capacitor and the second capacitor start to be charged, and the voltage of the first node, i.e. the gate voltage of the first thin film transistor $Vg=VDD-f(Vth)$, and VDD represents the power source positive voltage, and Vth represents the threshold voltage of the first thin film transistor, and f(Vth) is the function related with Vth, which represents the anode voltage of the organic light emitting diode as the first thin film transistor, the fourth thin film transistor and the organic light emitting diode reach the current balance;

step 3, entering a holding stage;

the nth scan signal provides high voltage level, and the second thin film transistor and the fourth thin film transistor are deactivated, and the n+1th scan signal provides high voltage level, and third thin film transistor is deactivated, and the first capacitor and the second capacitor start discharging and coupling with each other, and the voltage of the first node, i.e. the gate voltage of the first thin film transistor $Vg=VDD-f(Vth)+\Delta V1$, and $\Delta V1$ represents the first voltage variation value caused by the coupling function of the first capacitor and the second capacitor;

step 4, entering a programming stage;

the nth scan signal provides high voltage level, and the second thin film transistor and the fourth thin film transistor are deactivated, and the n+1th scan signal provides high voltage level, and third thin film transistor is deactivated, and the reference voltage is transmitted to the second node, and the voltage of the first node, i.e. the gate voltage of the first thin film transistor $Vg=VDD-f(Vth)+\Delta V1+Vref-Vdata$, and Vref represents the reference voltage, and Vdata represents the data signal voltage;

step 5, entering a drive stage;

the nth scan signal provides high voltage level, and the second thin film transistor and the fourth thin film transistor are deactivated, and the n+1th scan signal provides high voltage level, and third thin film transistor is deactivated, and the first capacitor and the second capacitor discharge again and couple with each other, and the voltage of the first node, i.e. the gate voltage of the first thin film transistor $Vg=VDD-f(Vth)+\Delta V1+Vref-Vdata+\Delta V2$, and $+\Delta V2$ represents the second voltage variation value caused by the coupling function of the first capacitor and the second capacitor; the organic light emitting diode emits light.

The reference voltage is a constant voltage.

All of the first thin film transistor, the second thin film transistor, the third thin film transistor and the fourth thin film transistor are Low Temperature Poly-silicon thin film transistors, oxide semiconductor thin film transistors or amorphous silicon thin film transistors.

The present invention further provides an AMOLED pixel driving circuit, comprising: a first thin film transistor, a second thin film transistor, a third thin film transistor, a fourth thin film transistor, a first capacitor, a second capacitor and an organic light emitting diode; all the respective thin film transistors are P type thin film transistors;

the first thin film transistor is a drive thin film transistor, and a gate thereof is electrically coupled to one end of the first capacitor through a first node, and a source is electrically coupled to a power source positive voltage, and a drain is electrically coupled to an anode of the organic light emitting diode;

a gate of the second thin film transistor receives a nth scan signal corresponded with a row where the pixel driving circuit is, and a source receives a data signal, and a drain is electrically coupled to the other end of the first capacitor through a second node;

a gate of the third thin film transistor receives a n+1th scan signal corresponded with a next row of the row where the pixel driving circuit is, and a source is electrically coupled to the second node, and a drain is electrically coupled to a reference voltage;

a gate of the fourth thin film transistor receives the nth scan signal corresponded with the row where the pixel driving circuit is, and a source is electrically coupled to the first node, and a drain is electrically coupled to the anode of the organic light emitting diode;

the one end of the first capacitor is electrically coupled to the first node, and the other end is electrically coupled to the second node;

one end of the second capacitor is electrically coupled to the first node, and the other end is electrically coupled to the power source positive voltage;

the anode of the organic light emitting diode is electrically coupled to the drain of the first thin film transistor and the drain of the fourth thin film transistor, and a cathode is electrically coupled to a power source negative voltage;

wherein the reference voltage is a constant voltage;

wherein all of the first thin film transistor, the second thin film transistor, the third thin film transistor and the fourth thin film transistor are Low Temperature Poly-silicon thin film transistors, oxide semiconductor thin film transistors or amorphous silicon thin film transistors.

The benefits of the present invention: the present invention provides an AMOLED pixel driving circuit utilizing the 4T2C structure. In comparison with the pixel driving circuit of the 5T2C structure, the corresponding thin film transistor is controlled merely with arranging the scan signal. There will be the compensation function, and the amount of the control signals can be decreased, and the circuit structure is simplified and the cost is decreased. The present invention provides an AMOLED pixel driving circuit, in which the corresponding thin film transistor is controlled merely with the scan signal so that the amount of the control signals can be decreased, and the circuit structure is simplified and the cost is decreased.

BRIEF DESCRIPTION OF THE DRAWINGS

In order to better understand the characteristics and technical aspect of the invention, please refer to the following detailed description of the present invention is concerned with the diagrams, however, provide reference to the accompanying drawings and description only and is not intended to be limiting of the invention.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 7:
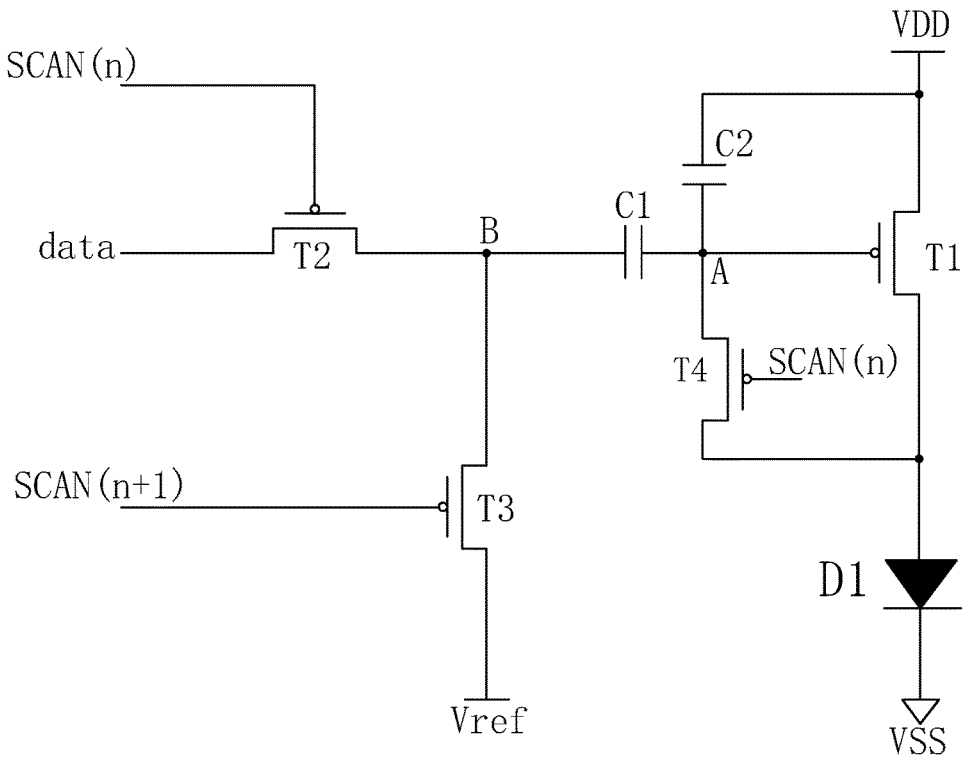
FIG. 7 is a circuit diagram of an AMOLED pixel driving circuit according to present invention.
Figure 8:
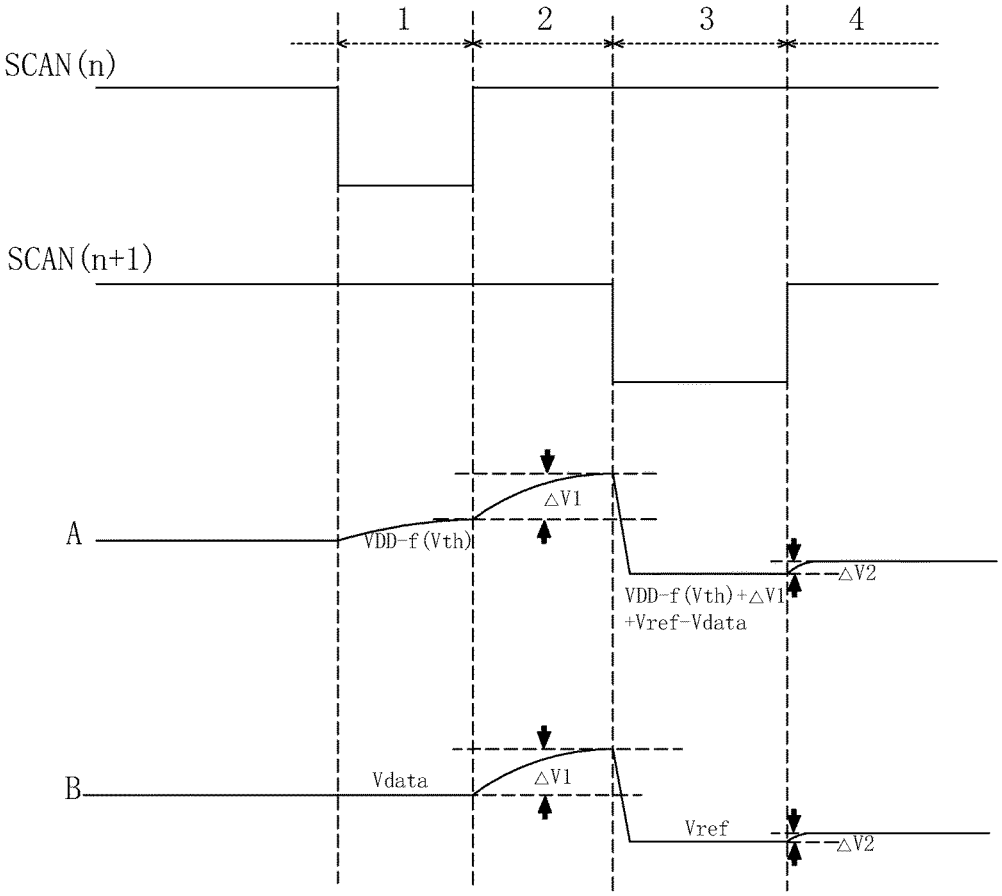
FIG. 8 is a sequence diagram of an AMOLED pixel driving circuit according to the present invention.

Please refer to FIG. 7 and FIG. 8, together. The present invention first provides an AMOLED pixel driving circuit. The AMOLED pixel driving circuit is the 4T2C structure, and comprises: a first thin film transistor T1, a second thin film transistor T2, a third thin film transistor T3, a fourth thin film transistor T4, a first capacitor C1, a second capacitor C2 and an organic light emitting diode D1. All the respective thin film transistors are P type thin film transistors.

the first thin film transistor T1 is a drive thin film transistor, and a gate thereof is electrically coupled to one end of the first capacitor C1 through a first node A, and a source is electrically coupled to a power source positive voltage VDD, and a drain is electrically coupled to an anode of the organic light emitting diode D1; a gate of the second thin film transistor T2 receives a nth scan signal SCAN(n) corresponded with a row where the pixel driving circuit is, and a source receives a data signal data, and a drain is electrically coupled to the other end of the first capacitor C1 through a second node B; a gate of the third thin film transistor T3 receives a n+1th scan signal SCAN(n+1) corresponded with a next row of the row where the pixel driving circuit is, and a source is electrically coupled to the second node B, and a drain is electrically coupled to a reference voltage Vref; a gate of the fourth thin film transistor T4 receives the nth scan signal SCAN(n) corresponded with the row where the pixel driving circuit is, and a source is electrically coupled to the first node A, and a drain is electrically coupled to the anode of the organic light emitting diode D1; the one end of the first capacitor C1 is electrically coupled to the first node A, and the other end is electrically coupled to the second node B; one end of the second capacitor C2 is electrically coupled to the first node A, and the other end is electrically coupled to the power source positive voltage VDD; the anode of the organic light emitting diode D1 is electrically coupled to the drain of the first thin film transistor T1 and the drain of the fourth thin film transistor T4, and a cathode is electrically coupled to a power source negative voltage VSS.

Specifically, all of the first thin film transistor T1, the second thin film transistor T2, the third thin film transistor T3, the fourth thin film transistor T4 are Low Temperature Poly-silicon thin film transistors, oxide semiconductor thin film transistors or amorphous silicon thin film transistors.

As shown in FIG. 8, the reference voltage Vref is a constant voltage; n is set to be a positive integer, and the nth scan signal SCAN(n) and the n+1th scan signal SCAN(n+1) are scan signals which are successively outputted by the same sequencer according to the order, and the pixel driving circuit of the nth row is cascade coupled to the pixel driving circuit of the n+1th row, and the nth scan signal SCAN(n) starts the scan to the pixel driving circuit of the nth row, and the n+1th scan signal SCAN(n+1) starts the scan to the pixel driving circuit of the n+1th row.

The scan signal is a pulse signal but significantly, being different from prior art, in which the falling edge of the n+1th scan signal SCAN(n+1) is generally set to be generated at the same time with the rising edge of the nth scan signal SCAN(n), a falling edge of the n+1th scan signal SCAN(n+1) is later than a rising edge of the nth scan signal SCAN(n) in the present invention, and the two are combined with each other to control the pixel driving circuit, and correspond to a threshold voltage sensing stage 1, a holding stage 2, a programming stage 3 and a drive stage 4 one after another.

Figure 9:
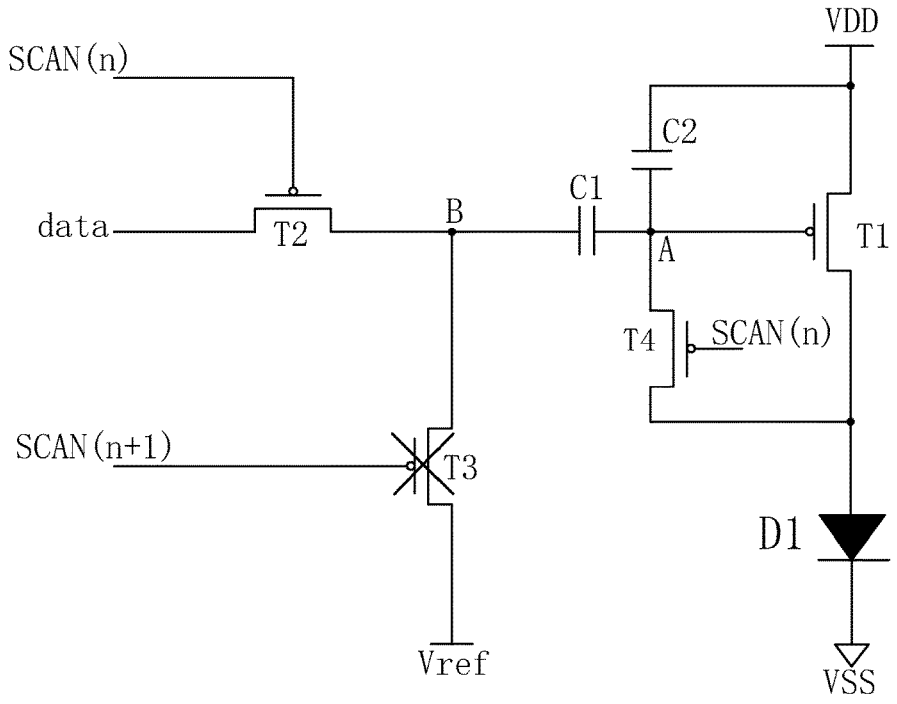
FIG. 9 is a circuit diagram of an AMOLED pixel driving circuit in a threshold voltage sensing stage, and also a circuit diagram of the step 2 in the AMOLED pixel driving method according to the present invention.

Furthermore, with combination of FIG. 8 and FIG. 9, in the threshold voltage sensing stage 1, the nth scan signal SCAN(n) is low voltage level, and the second thin film transistor T2 and the fourth thin film transistor T4 controlled by the nth scan signal SCAN(n) are activated, and the n+1th scan signal SCAN(n+1) is high voltage level, and third thin film transistor T3 controlled by the n+1th scan signal SCAN (n+1) is deactivated; the data signal data is transmitted to the second node B through the second thin film transistor T2 to make the voltage of the second node B to be the data signal voltage Vdata; the first capacitor C1 and the second capacitor C2 start to be charged, and because the fourth thin film transistor T4 is activated, the voltage of the first node A, i.e. the gate voltage Vg of the first thin film transistor T1 is:

$$Vg=VDD-f(\mathrm{Vth}) \quad (1)$$

wherein VDD represents the power source positive voltage, and Vth represents the threshold voltage of the drive thin film transistor, i.e. the first thin film transistor T1, and f(Vth) is the function related with Vth, which represents the anode voltage of the organic light emitting diode D1 as the first thin film transistor T1, the fourth thin film transistor T4 and the organic light emitting diode D1 reach the current balance;

the source voltage of the first thin film transistor T1 is Vs=VDD.

Figure 10:
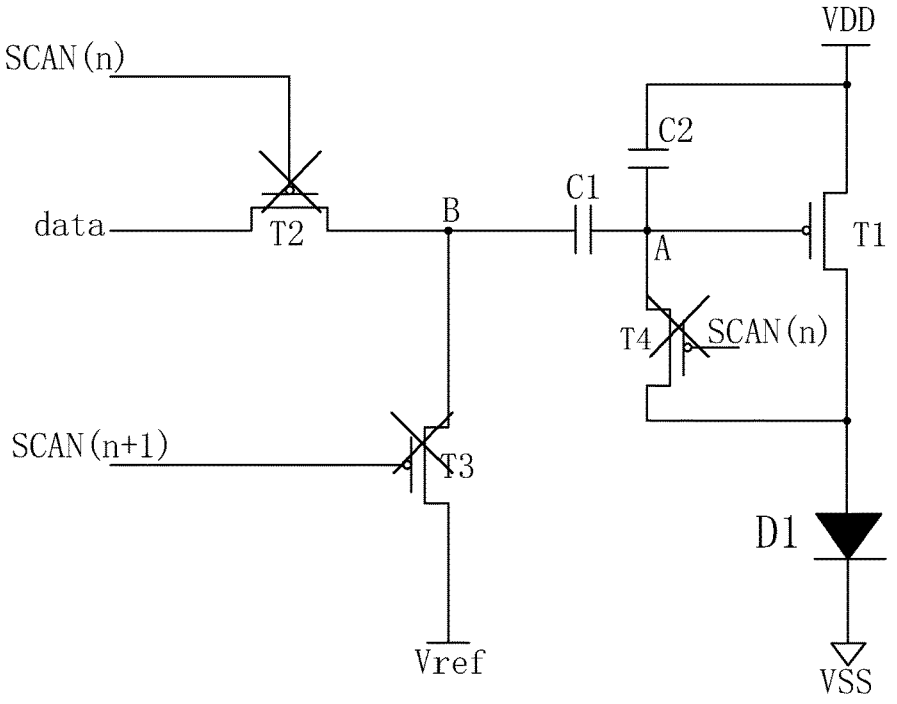
FIG. 10 is a circuit diagram of an AMOLED pixel driving circuit in a holding stage, and also a circuit diagram of the step 3 in the AMOLED pixel driving method according to the present invention.

With combination of FIG. 8 and FIG. 10, in the holding stage 2, the nth scan signal SCAN(n) is changed to be high voltage level, and the second thin film transistor T2 and the fourth thin film transistor T4 are deactivated, and the n+1th scan signal SCAN(n+1) provides high voltage level, and third thin film transistor T3 is deactivated, and the first capacitor C1 and the second capacitor C2 start discharging and coupling with each other, and the voltage of the first node A, i.e. the gate voltage of the first thin film transistor T1 is:

$$Vg=VDD-f(\mathrm{Vth})+\Delta V1 \tag{2}$$

wherein ΔV1 represents the first voltage variation value caused by the coupling function of the first capacitor C1 and the second capacitor C2;

the source voltage of the first thin film transistor T1 is Vs=VDD;

the voltage of the second node B at the other end of the first capacitor C1 correspondingly changes with ΔV1 along with the first node A.

Figure 11:
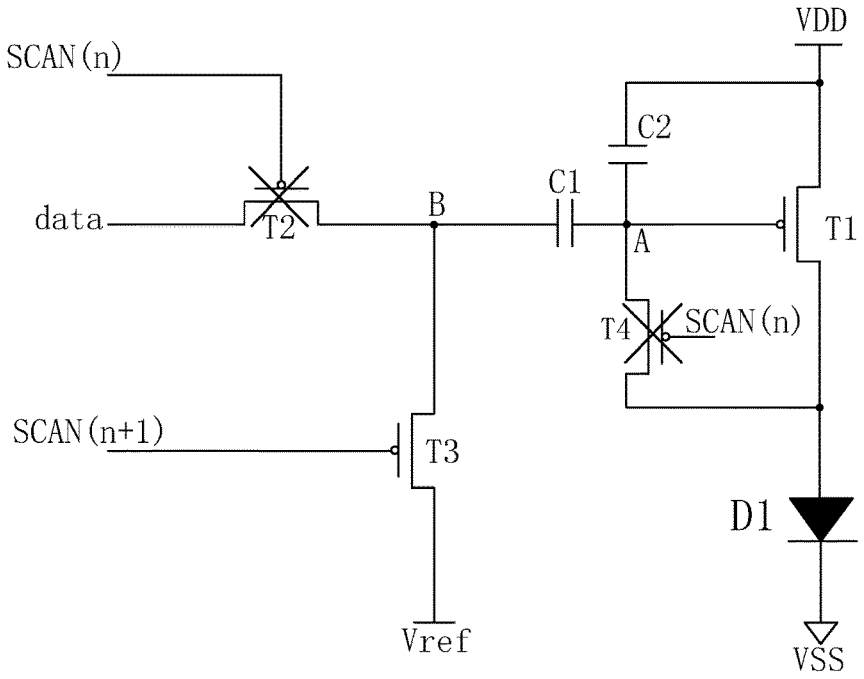
FIG. 11 is a circuit diagram of an AMOLED pixel driving circuit in a programming stage, and also a circuit diagram of the step 4 in the AMOLED pixel driving method according to the present invention.

With combination of FIG. 8 and FIG. 11, in the programming stage 3, the nth scan signal SCAN(n) remains to be high voltage level, and the second thin film transistor T2 and the fourth thin film transistor T4 are deactivated, and the n+1th scan signal SCAN(n+1) is changed to be low voltage level, and third thin film transistor T3 is deactivated, and the reference voltage Vref is transmitted to the second node B through the third thin film transistor T3, and the voltage of the first node A at one end of the first capacitor C1, i.e. the gate voltage of the first thin film transistor T1 is:

$$Vg=VDD-f(\mathrm{Vth})+\Delta V1+V\mathrm{ref}-V\mathrm{data} \tag{3}$$

wherein Vref represents the reference voltage, and Vdata represents the data signal voltage;

the source voltage of the first thin film transistor T1 is Vs=VDD.

Figure 12:
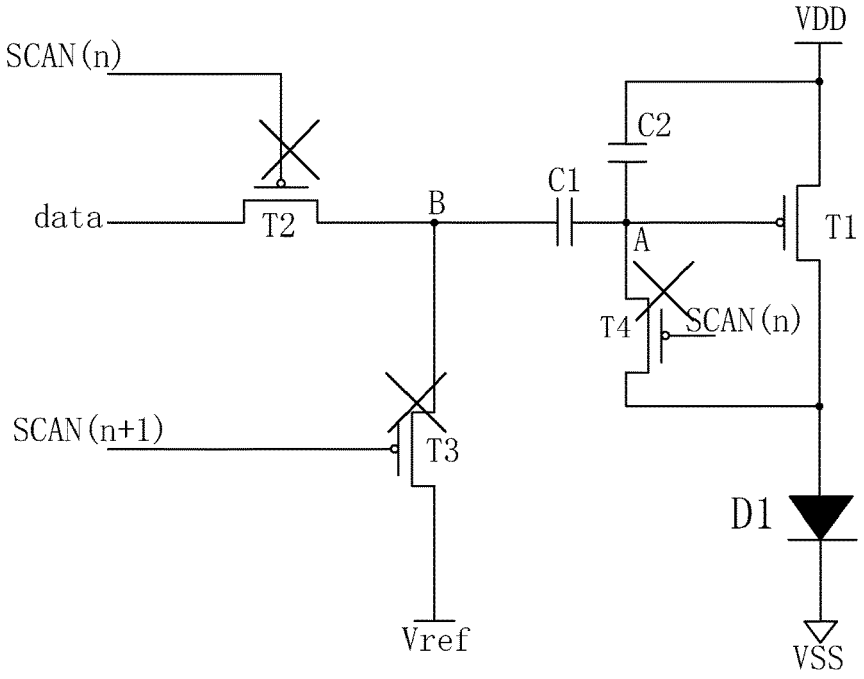
FIG. 12 is a circuit diagram of an AMOLED pixel driving circuit in a drive stage, and also a circuit diagram of the step 5 in the AMOLED pixel driving method according to the present invention.

With combination of FIG. 8 and FIG. 12, in the drive stage 4, the nth scan signal SCAN(n) remains to be high voltage level, and the second thin film transistor T2 and the fourth thin film transistor T4 are deactivated, and the n+1th scan signal SCAN(n+1) is changed to be high voltage level, and third thin film transistor T3 is deactivated, and the first capacitor C1 and the second capacitor C2 discharge again and couple with each other, and the voltage of the first node A, i.e. the gate voltage of the first thin film transistor T1 is:

$$Vg=VDD-f(\mathrm{Vth})+\Delta V1+V\mathrm{ref}-V\mathrm{data}+\Delta V2 \tag{4}$$

wherein ΔV2 represents the second voltage variation value caused by the coupling function of the first capacitor C1 and the second capacitor C2;

the source voltage of the first thin film transistor T1 is:

$$Vs=VDD \tag{5}$$

the voltage of the second node B at the other end of the first capacitor C1 correspondingly changes with ΔV2 along with the first node A;

the organic light emitting diode D1 emits light.

Furthermore, as known, the formula of calculating the current flowing through the organic light emitting diode as the drive thin film transistor is a P type thin film transistor is:

$$I_{OLED}=\tfrac{1}{2}\mathrm{Cox}(\mu W/L)(Vgs+\mathrm{Vth})^2 \tag{6}$$

wherein $I_{OLED}$ is the current of the organic light emitting diode D1, μ is the carrier mobility of the drive thin film transistor, i.e. the first thin film transistor T1, and W and L respectively are the width and the length of the channel of the drive thin film transistor, i.e. the first thin film transistor T1, and Vgs is the gate-source voltage of the drive thin film transistor, i.e. the first thin film transistor T1, and Vth is the threshold voltage of the drive thin film transistor, i.e. the first thin film transistor T1.

$$\begin{aligned} Vgs &= Vg - Vs \\ &= VDD - f(Vth) + \Delta V1 + Vref - \\ &\quad Vdata + \Delta V2 - VDD \\ &= \Delta V1 + Vref - Vdata + \Delta V2 - f(Vth) \end{aligned} \tag{7}$$

The formula (7) is substituted into the formula (6) to obtain:

$$I_{OLED}=\tfrac{1}{2}\mathrm{Cox}(\mu W/L)(\Delta V1+V\mathrm{ref}-V\mathrm{data}+\Delta V2+\mathrm{Vth}-f(\mathrm{Vth}))^2 \tag{8}$$

Figure 13:
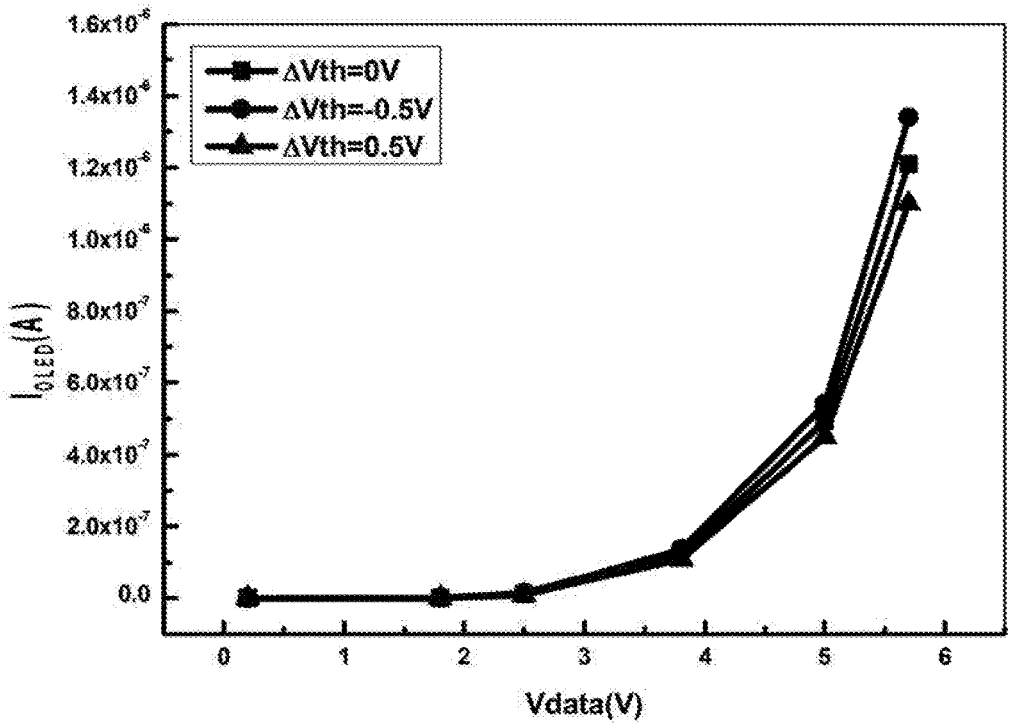
FIG. 13 is a result diagram that the AMOLED pixel driving method according to the present invention compensates the threshold voltage of the drive thin film transistor.

As shown in FIG. 13, because −f(Vth) cancels out a part of Vth, the influence of the threshold voltage Vth of the first thin film transistor T1 to the current of the organic light emitting diode D1 is smaller to achieve the compensation function.

Figure 1:
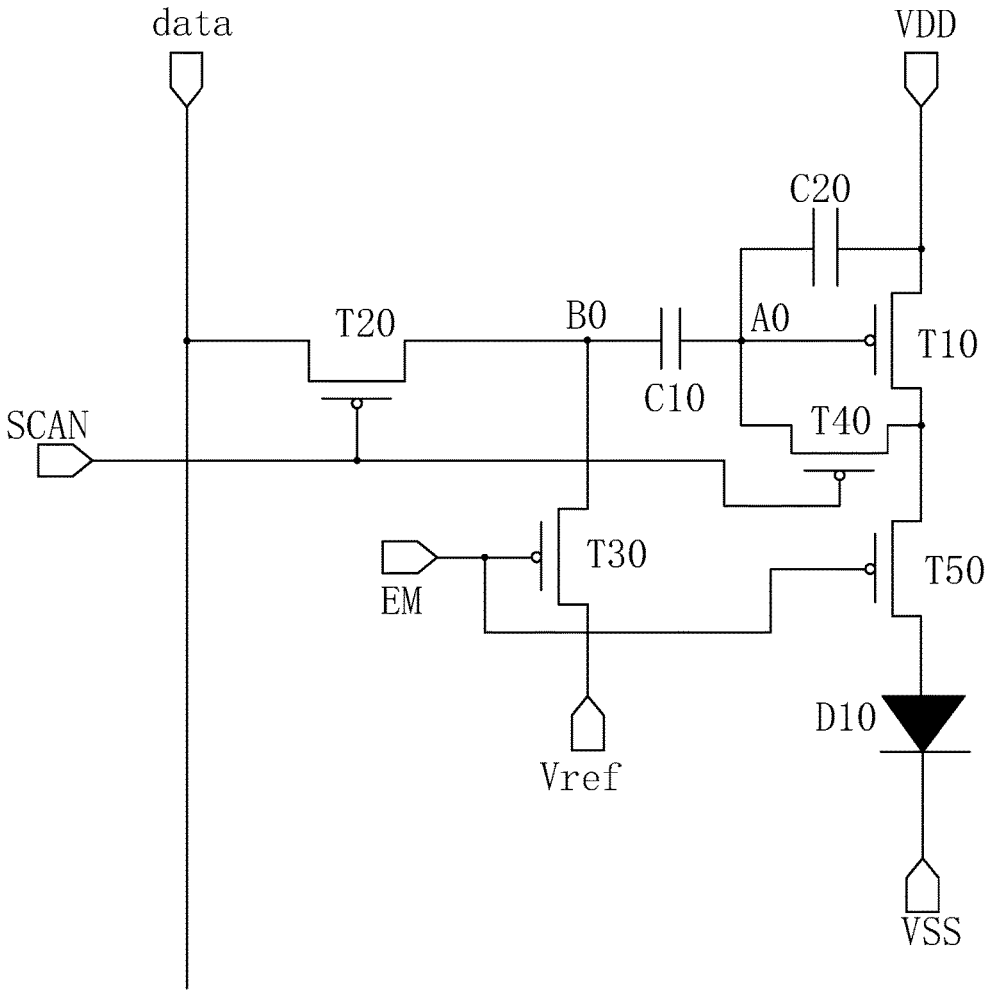
FIG. 1 is a circuit diagram of an AMOLED pixel driving circuit utilizing the 5T2C structure according to prior art.
Figure 2:
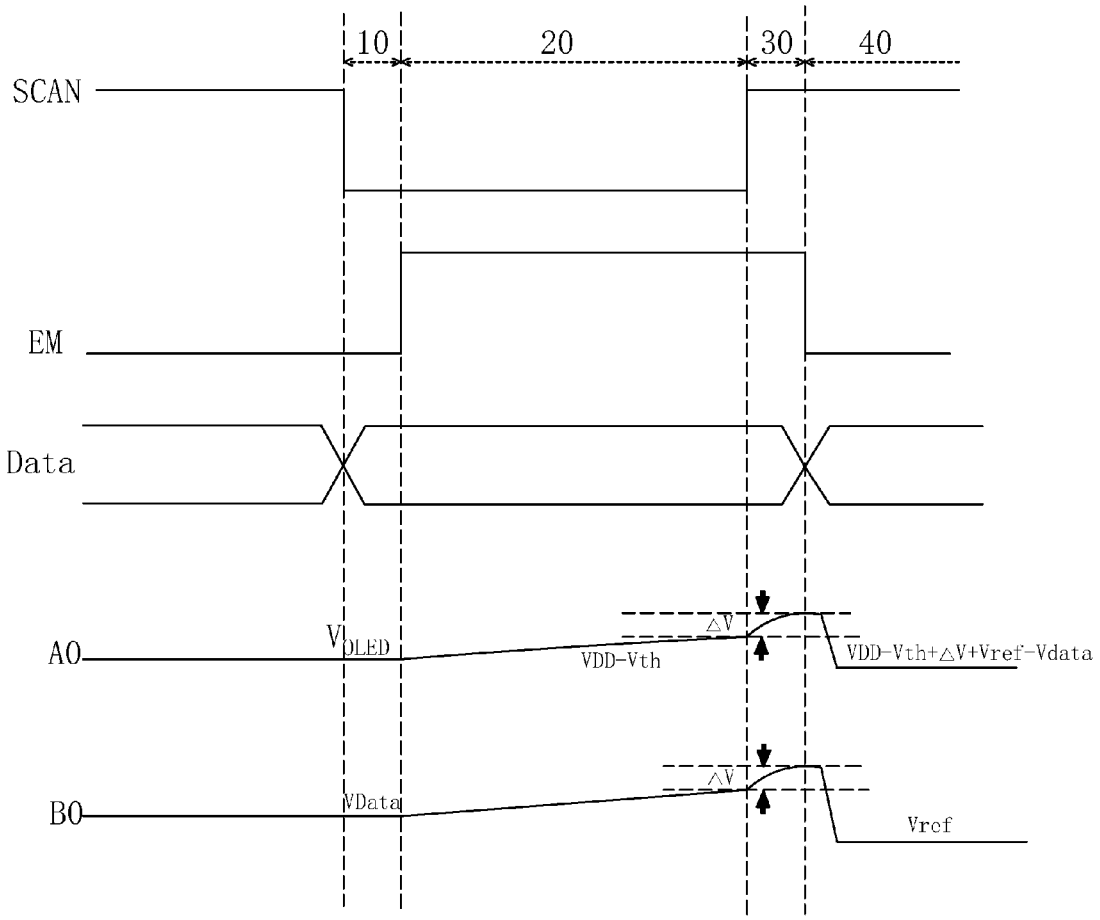
FIG. 2 is a sequence diagram of the AMOLED pixel driving circuit shown in FIG. 1.
Figure 3:
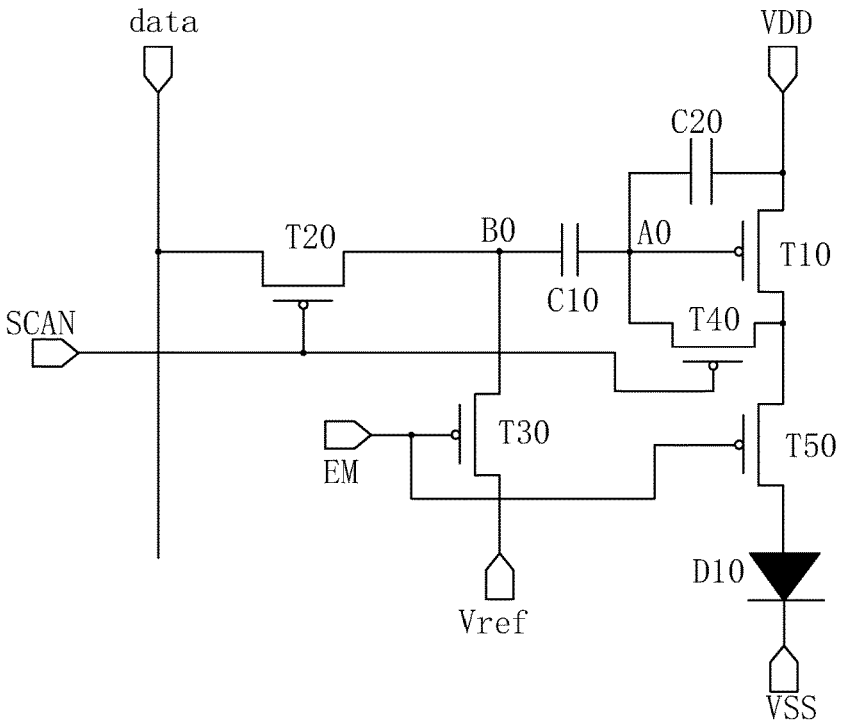
FIG. 3 is a diagram of the AMOLED pixel driving circuit shown in FIG. 1 in an initializing stage.
Figure 4:
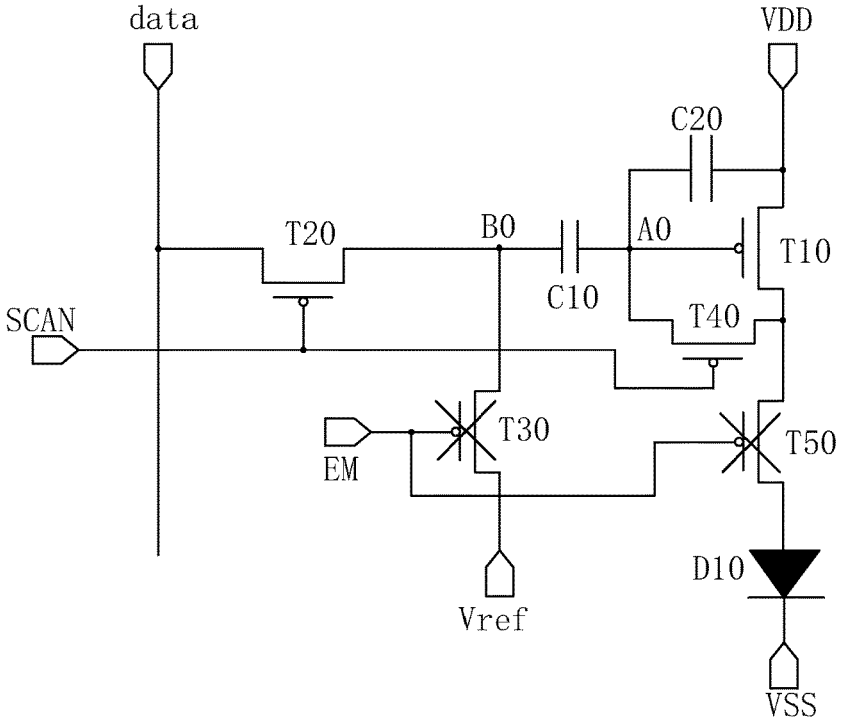
FIG. 4 is a diagram of the AMOLED pixel driving circuit shown in FIG. 1 in a sampling stage.
Figure 5:
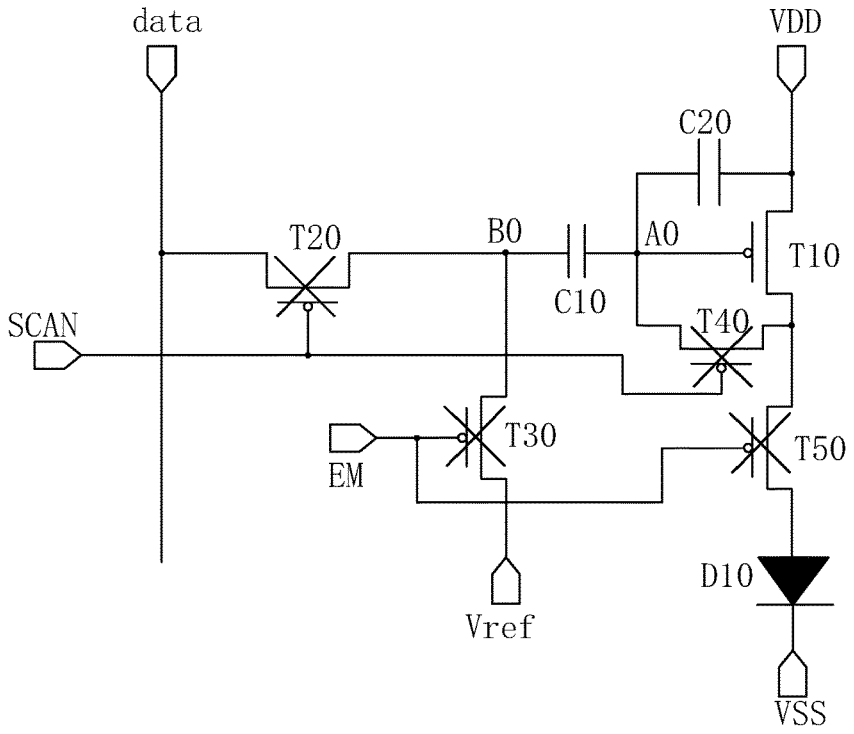
FIG. 5 is a diagram of the AMOLED pixel driving circuit shown in FIG. 1 in a holding stage.
Figure 6:
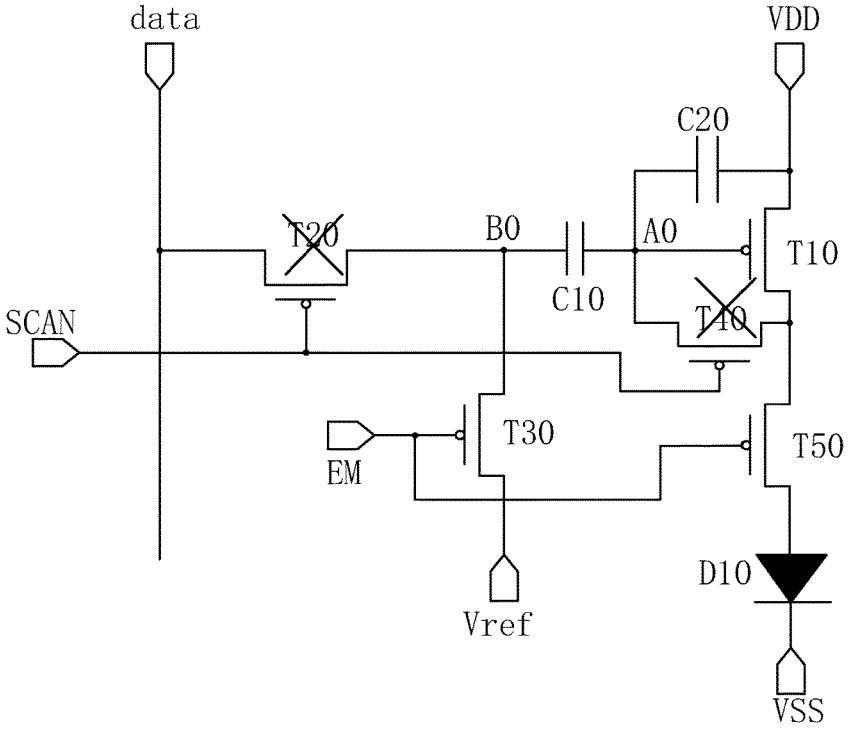
FIG. 6 is a diagram of the AMOLED pixel driving circuit shown in FIG. 1 in a drive stage.

In comparison with the AMOLED pixel driving circuit of 5T2C structure in prior shown in FIG. 1, the AMOLED pixel driving circuit of the present invention eliminates the thin film transistor, which is coupled between the drive thin film transistor and the anode of the organic light emitting diode, and the nth scan signal SCAN(n) is in charge of controlling the second thin film transistor T2 and the fourth thin film transistor T4, and the n+1th scan signal SCAN(n+1) is in charge of controlling the third thin film transistor T3. The corresponding thin film transistor is controlled merely with arranging the scan signal. There will be the compensation function, and the amount of the control signals can be decreased, and the circuit structure is simplified and the cost is decreased.

On the basis of the same inventive idea, the present invention further provides a AMOLED pixel driving method, comprising steps of:

step 1, providing an AMOLED pixel driving circuit.

As shown in FIG. 7, the AMOLED pixel driving circuit comprises: a first thin film transistor T1, a second thin film transistor T2, a third thin film transistor T3, a fourth thin film transistor T4, a first capacitor C1, a second capacitor C2 and an organic light emitting diode D1. All the respective thin film transistors are P type thin film transistors.

the first thin film transistor T1 is a drive thin film transistor, and a gate thereof is electrically coupled to one end of the first capacitor C1 through a first node A, and a source is electrically coupled to a power source positive voltage VDD, and a drain is electrically coupled to an anode of the organic light emitting diode D1; a gate of the second thin film transistor T2 receives a nth scan signal SCAN(n) corresponded with a row where the pixel driving circuit is, and a source receives a data signal data, and a drain is electrically coupled to the other end of the first capacitor C1 through a second node B; a gate of the third thin film transistor T3 receives a n+1th scan signal SCAN(n+1) corresponded with a next row of the row where the pixel driving circuit is, and a source is electrically coupled to the second node B, and a drain is electrically coupled to a reference voltage Vref; a gate of the fourth thin film transistor T4 receives the nth scan signal SCAN(n) corresponded with the row where the pixel driving circuit is, and a source is electrically coupled to the first node A, and a drain is electrically coupled to the anode of the organic light emitting diode D1; the one end of the first capacitor C1 is electrically coupled to the first node A, and the other end is electrically coupled to the second node B; one end of the second capacitor C2 is electrically coupled to the first node A, and the other end is electrically coupled to the power source positive voltage VDD; the anode of the organic light emitting diode D1 is electrically coupled to the drain of the first thin film transistor T1 and the drain of the fourth thin film transistor T4, and a cathode is electrically coupled to a power source negative voltage VSS.

Specifically, all of the first thin film transistor T1, the second thin film transistor T2, the third thin film transistor T3, the fourth thin film transistor T4 are Low Temperature Poly-silicon thin film transistors, oxide semiconductor thin film transistors or amorphous silicon thin film transistors.

As shown in FIG. 8, the reference voltage Vref is a constant voltage; n is set to be a positive integer, and the nth scan signal SCAN(n) and the n+1th scan signal SCAN(n+1) are scan signals which are successively outputted by the same sequencer according to the order, and the pixel driving circuit of the nth row is cascade coupled to the pixel driving circuit of the n+1th row, and the nth scan signal SCAN(n) starts the scan to the pixel driving circuit of the nth row, and the n+1th scan signal SCAN(n+1) starts the scan to the pixel driving circuit of the n+1th row.

The scan signal is a pulse signal but significantly, being different from prior art, in which the falling edge of the n+1th scan signal SCAN(n+1) is generally set to be generated at the same time with the rising edge of the nth scan signal SCAN(n), a falling edge of the n+1th scan signal SCAN(n+1) is later than a rising edge of the nth scan signal SCAN(n) in the present invention.

step 2, entering a threshold voltage sensing stage 1.

With combination of FIG. 8 and FIG. 9, the nth scan signal SCAN(n) provides low voltage level, and the second thin film transistor T2 and the fourth thin film transistor T4 controlled by the nth scan signal SCAN(n) are activated, and the n+1th scan signal SCAN(n+1) provides high voltage level, and third thin film transistor T3 controlled by the n+1th scan signal SCAN(n+1) is deactivated; the data signal data is transmitted to the second node B through the second thin film transistor T2 to make the voltage of the second node B to be the data signal voltage Vdata; the first capacitor C1 and the second capacitor C2 start to be charged, and because the fourth thin film transistor T4 is activated, the voltage of the first node A, i.e. the gate voltage Vg of the first thin film transistor T1 is:

$$Vg=VDD-f(\mathrm{Vth}) \tag{1}$$

wherein VDD represents the power source positive voltage, and Vth represents the threshold voltage of the drive thin film transistor, i.e. the first thin film transistor T1, and f(Vth) is the function related with Vth, which represents the anode voltage of the organic light emitting diode D1 as the first thin film transistor T1, the fourth thin film transistor T4 and the organic light emitting diode D1 reach the current balance;

the source voltage of the first thin film transistor T1 is Vs=VDD.

step 3, entering a holding stage 2.

With combination of FIG. 8 and FIG. 10, the nth scan signal SCAN(n) provides high voltage level, and the second thin film transistor T2 and the fourth thin film transistor T4 are deactivated, and the n+1th scan signal SCAN(n+1) provides high voltage level, and third thin film transistor T3 is deactivated, and the first capacitor C1 and the second capacitor C2 start discharging and coupling with each other, and the voltage of the first node A, i.e. the gate voltage of the first thin film transistor T1 is:

$$Vg=VDD-f(\mathrm{Vth})+\Delta V1 \tag{2}$$

wherein ΔV1 represents the first voltage variation value caused by the coupling function of the first capacitor C1 and the second capacitor C2;

the source voltage of the first thin film transistor T1 is Vs=VDD;

the voltage of the second node B at the other end of the first capacitor C1 correspondingly changes with ΔV1 along with the first node A.

step 4, entering a programming stage 3.

With combination of FIG. 8 and FIG. 11, the nth scan signal SCAN(n) provides high voltage level, and the second thin film transistor T2 and the fourth thin film transistor T4 are deactivated, and the n+1th scan signal SCAN(n+1) provides high voltage level, and third thin film transistor T3 is deactivated, and the reference voltage Vref is transmitted to the second node B through the third thin film transistor T3, and the voltage of the first node A at one end of the first capacitor C1, i.e. the gate voltage of the first thin film transistor T1 is:

$$Vg=VDD-f(\mathrm{Vth})+\Delta V1+V\mathrm{ref}-V\mathrm{data} \tag{3}$$

wherein Vref represents the reference voltage, and Vdata represents the data signal voltage;

the source voltage of the first thin film transistor T1 is Vs=VDD.

step 5, entering a drive stage 4.

With combination of FIG. 8 and FIG. 12, the nth scan signal SCAN(n) provides high voltage level, and the second thin film transistor T2 and the fourth thin film transistor T4 are deactivated, and the n+1th scan signal SCAN(n+1) provides high voltage level, and third thin film transistor T3 is deactivated, and the first capacitor C1 and the second capacitor C2 discharge again and couple with each other, and the voltage of the first node A, i.e. the gate voltage of the first thin film transistor T1 is:

$$Vg=VDD-f(\mathrm{Vth})+\Delta V1+V\mathrm{ref}-V\mathrm{data}+\Delta V2 \tag{4}$$

wherein ΔV2 represents the second voltage variation value caused by the coupling function of the first capacitor C1 and the second capacitor C2;

the source voltage of the first thin film transistor T1 is:

$$Vs=VDD \tag{5}$$

the voltage of the second node B at the other end of the first capacitor C1 correspondingly changes with ΔV2 along with the first node A;

the organic light emitting diode D1 emits light.

Furthermore, as known, the formula of calculating the current flowing through the organic light emitting diode as the drive thin film transistor is a P type thin film transistor is:

$$I_{OLED}=\tfrac{1}{2}\mathrm{Cox}(\mu W/L)(Vgs+\mathrm{Vth})^2 \tag{6}$$

wherein $I_{OLED}$ is the current of the organic light emitting diode D1, μ is the carrier mobility of the drive thin film transistor, i.e. the first thin film transistor T1, and W and L respectively are the width and the length of the channel of the drive thin film transistor, i.e. the first thin film transistor T1, and Vgs is the gate-source voltage of the drive thin film transistor, i.e. the first thin film transistor T1, and Vth is the threshold voltage of the drive thin film transistor, i.e. the first thin film transistor T1.

$$\begin{aligned} Vgs &= Vg - Vs \\ &= VDD - f(Vth) + \Delta V1 + Vref - \\ &\quad Vdata + \Delta V2 - VDD \\ &= \Delta V1 + Vref - Vdata + \Delta V2 - f(Vth) \end{aligned} \tag{7}$$

The formula (7) is substituted into the formula (6) to obtain:

$$I_{OLED} = \tfrac{1}{2}\mathrm{Cox}(\mu W/L)(\Delta V1 + V\mathrm{ref} - V\mathrm{data} + \Delta V2 + \mathrm{Vth} - f(\mathrm{Vth}))^2 \tag{8}$$

As shown in FIG. 13, because −f(Vth) cancels out a part of Vth, the influence of the threshold voltage Vth of the first thin film transistor T1 to the current of the organic light emitting diode D1 in the step 5 is smaller to achieve the compensation function.

The AMOLED pixel driving method of the present invention utilizes the pixel driving circuit of 4T2C structure. The nth scan signal SCAN(n) is utilized to control the second thin film transistor T2 and the fourth thin film transistor T4, and the n+1th scan signal SCAN(n+1) is utilized to replace the light emitting control signal EM in prior art to control the third thin film transistor T3. Namely, the corresponding thin film transistor is controlled merely with the scan signal. There will be the compensation function, and the amount of the control signals can be decreased, and the circuit structure is simplified and the cost is decreased.

In conclusion, the present invention provides an AMOLED pixel driving circuit utilizing the 4T2C structure. In comparison with the pixel driving circuit of the 5T2C structure, the corresponding thin film transistor is controlled merely with arranging the scan signal. There will be the compensation function, and the amount of the control signals can be decreased, and the circuit structure is simplified and the cost is decreased. The present invention provides an AMOLED pixel driving circuit, in which the corresponding thin film transistor is controlled merely with the scan signal so that the amount of the control signals can be decreased, and the circuit structure is simplified and the cost is decreased.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. An active matrix organic light emitting display pixel driving circuit, comprising: a first thin film transistor, a second thin film transistor, a third thin film transistor, a fourth thin film transistor, a first capacitor, a second capacitor and an organic light emitting diode, wherein all the respective first thin film transistor, second thin film transistor, third thin film transistor and fourth thin film transistor are P type thin film transistors;

wherein the first thin film transistor is a drive thin film transistor, and a gate of the first thin film transistor is electrically coupled to a first end of the first capacitor through a first node, and a source of the first thin film transistor is electrically coupled to a power source positive voltage, and a drain of the first thin film transistor is electrically coupled to an anode of the organic light emitting diode;

a gate of the second thin film transistor receives a current-row scan signal that corresponds to a current row where the pixel driving circuit is located, and a source of the second thin film transistor receives a data signal, and a drain of the second thin film transistor is electrically coupled to a second end of the first capacitor through a second node;

a gate of the third thin film transistor receives a next-row scan signal that corresponds to a next row that is next to the current row where the pixel driving circuit is, and a source of the third thin film transistor is electrically coupled to the second node, and a drain of the third thin film transistor is electrically coupled to a reference voltage;

a gate of the fourth thin film transistor receives the current-row scan signal, and a source of the fourth thin film transistor is electrically coupled to the first node, and a drain of the fourth thin film transistor is electrically coupled to the anode of the organic light emitting diode;

the first end of the first capacitor is electrically coupled to the first node, and the second end of the first capacitor is electrically coupled to the second node;

a first end of the second capacitor is electrically coupled to the first node, and a second end of the second capacitor is electrically coupled to the power source positive voltage; and the anode of the organic light emitting diode is electrically coupled to the drain of the first thin film transistor and the drain of the fourth thin film transistor, and a cathode of the organic light emitting diode is electrically coupled to a power source negative voltage; and wherein the drain of the second thin film transistor and the source of the third thin film transistor are both electrically shorted to the second end of the first capacitor and wherein the second thin film transistor and the third thin film transistor are respectively controlled by the current-row scan signal and the next-row scan signal to supply the data signal and the reference voltage to the second end of the first capacitor at different time periods that are separated by a time interval therebetween.

2. The active matrix organic light emitting display pixel driving circuit according to claim 1, wherein the reference voltage is a constant voltage.

3. The active matrix organic light emitting display pixel driving circuit according to claim 1, wherein all of the first thin film transistor, the second thin film transistor, the third thin film transistor and the fourth thin film transistor are Low Temperature Poly-silicon thin film transistors, oxide semiconductor thin film transistors or amorphous silicon thin film transistors.

4. The active matrix organic light emitting display pixel driving circuit according to claim 1, wherein the current-row scan signal and the next-row scan signal are each a pulse signal having a falling edge and a rising edge, and the falling edge of the next-row scan signal is later than the rising edge of the current-row scan signal.

5. The active matrix organic light emitting display pixel driving circuit according to claim 4, wherein the current-row scan signal and the next-row scan signal are combined with each other to provide a threshold voltage sensing stage, a holding stage, a programming stage and a drive stage one after another;

in the threshold voltage sensing stage, the current-row scan signal is a low voltage level, and the next-row scan signal is a high voltage level;

in the holding stage, the current-row scan signal is a high voltage level, and the next-row scan signal is a high voltage level;

in the programming stage, the current-row scan signal is a high voltage level, and the next-row scan signal is a low voltage level;

in the drive stage, the current-row scan signal is a high voltage level, and the next-row scan signal is a high voltage level.

6. An active matrix organic light emitting display pixel driving method, comprising the following steps:

step 1, providing an active matrix organic light emitting display pixel driving circuit;

wherein the active matrix organic light emitting display pixel driving circuit comprises: a first thin film transistor, a second thin film transistor, a third thin film transistor, a fourth thin film transistor, a first capacitor, a second capacitor and an organic light emitting diode, wherein all the respective first thin film transistor, second thin film transistor, third thin film transistor and fourth thin film transistor are P type thin film transistors;

wherein the first thin film transistor is a drive thin film transistor, and a gate of the first thin film transistor is electrically coupled to a first end of the first capacitor through a first node, and a source of the first thin film transistor is electrically coupled to a power source positive voltage, and a drain of the first thin film transistor is electrically coupled to an anode of the organic light emitting diode;

a gate of the second thin film transistor receives a current-row scan signal that corresponds to a current row where the pixel driving circuit is, and a source of the second thin film transistor receives a data signal, and a drain of the second thin film transistor is electrically coupled to a second end of the first capacitor through a second node;

a gate of the third thin film transistor receives a next-row scan signal that corresponds to a next row that is next to the current row where the pixel driving circuit is, and a source of the third thin film transistor is electrically coupled to the second node, and a drain of the third thin film transistor is electrically coupled to a reference voltage;

a gate of the fourth thin film transistor receives the current-row scan signal, and a source of the fourth thin film transistor is electrically coupled to the first node, and a drain of the fourth thin film transistor is electrically coupled to the anode of the organic light emitting diode;

the first end of the first capacitor is electrically coupled to the first node, and the second end of the first capacitor is electrically coupled to the second node;

a first end of the second capacitor is electrically coupled to the first node, and a second end of the second capacitor is electrically coupled to the power source positive voltage; and the anode of the organic light emitting diode is electrically coupled to the drain of the first thin film transistor and the drain of the fourth thin film transistor, and a cathode of the organic light emitting diode is electrically coupled to a power source negative voltage;

step 2, entering a threshold voltage sensing stage;

wherein the current-row scan signal provides a low voltage level, so that the second thin film transistor and the fourth thin film transistor are activated, and the next-row scan signal provides a high voltage level, so that the third thin film transistor is deactivated; the data signal is transmitted to the second node, and the first capacitor and the second capacitor start to be charged, and a voltage of the first node, which corresponds to a gate voltage of the first thin film transistor, is $Vg=VDD-f(Vth)$, where VDD represents the power source positive voltage, and Vth represents the threshold voltage of the first thin film transistor, and f(Vth) is a function related with Vth, which represents an anode voltage of the organic light emitting diode as the first thin film transistor, the fourth thin film transistor and the organic light emitting diode reach a current balance;

step 3, entering a holding stage;

wherein the current-row scan signal provides a high voltage level, so that the second thin film transistor and the fourth thin film transistor are deactivated, and the next-row scan signal provides a high voltage level, so that the third thin film transistor is deactivated, and the first capacitor and the second capacitor start discharging and coupling with each other, and the voltage of the first node, which corresponds to the gate voltage of the first thin film transistor, becomes $Vg=VDD-f(Vth)+\Delta V1$, where $\Delta V1$ represents a first voltage variation value caused by the coupling of the first capacitor and the second capacitor with each other;

step 4, entering a programming stage;

wherein the current-row scan signal provides a high voltage level, so that the second thin film transistor and the fourth thin film transistor are deactivated, and the next-row scan signal provides a high voltage level, so that the third thin film transistor is deactivated, and the reference voltage is transmitted to the second node, and the voltage of the first node, which corresponds to the gate voltage of the first thin film transistor, becomes $Vg=VDD-f(Vth)+\Delta V1+Vref-Vdata$, where Vref represents the reference voltage, and Vdata represents the data signal voltage; and step 5, entering a drive stage;

wherein the current-row scan signal provides a high voltage level, so that the second thin film transistor and the fourth thin film transistor are deactivated, and the next-row scan signal provides a high voltage level, so that the third thin film transistor is deactivated, and the first capacitor and the second capacitor discharge again and couple with each other, and the voltage of the first node, which corresponds to the gate voltage of the first thin film transistor, becomes $Vg=VDD-f(Vth)+\Delta V1+Vref-Vdata+\Delta V2$, where $\Delta V2$ represents a second voltage variation value caused by the coupling of the first capacitor and the second capacitor with each other; and the organic light emitting diode emits light;

wherein the drain of the second thin film transistor and the source of the third thin film transistor are both electrically shorted to the second end of the first capacitor and wherein the second thin film transistor and the third thin film transistor are respectively controlled by the current-row scan signal and the next-row scan signal to supply the data signal and the reference voltage to the second end of the first capacitor at different time periods that are separated by a time interval therebetween.

7. The active matrix organic light emitting display pixel driving method according to claim 6, wherein the reference voltage is a constant voltage.

8. The active matrix organic light emitting display pixel driving method according to claim 6, wherein all of the first thin film transistor, the second thin film transistor, the third thin film transistor and the fourth thin film transistor are Low Temperature Poly-silicon thin film transistors, oxide semiconductor thin film transistors or amorphous silicon thin film transistors.

9. An active matrix organic light emitting display pixel driving circuit, comprising: a first thin film transistor, a second thin film transistor, a third thin film transistor, a fourth thin film transistor, a first capacitor, a second capacitor and an organic light emitting diode, wherein all the respective first thin film transistor, second thin film transistor, third thin film transistor and fourth thin film transistor are P type thin film transistors;

wherein the first thin film transistor is a drive thin film transistor, and a gate of the first thin film transistor is electrically coupled to a first end of the first capacitor through a first node, and a source of the first thin film transistor is electrically coupled to a power source positive voltage, and a drain of the first thin film transistor is electrically coupled to an anode of the organic light emitting diode;

a gate of the second thin film transistor receives a current-row scan signal that corresponds to a current row where the pixel driving circuit is located, and a source of the second thin film transistor receives a data signal, and a drain of the second thin film transistor is electrically coupled to a second end of the first capacitor through a second node;

a gate of the third thin film transistor receives a next-row scan signal that corresponds to a next row that is next to the current row where the pixel driving circuit is, and a source of the third thin film transistor is electrically coupled to the second node, and a drain of the third thin film transistor is electrically coupled to a reference voltage;

a gate of the fourth thin film transistor receives the current-row scan signal, and a source of the fourth thin film transistor is electrically coupled to the first node, and a drain of the fourth thin film transistor is electrically coupled to the anode of the organic light emitting diode;

the first end of the first capacitor is electrically coupled to the first node, and the second end of the first capacitor is electrically coupled to the second node;

a first end of the second capacitor is electrically coupled to the first node, and a second end of the second capacitor is electrically coupled to the power source positive voltage; and the anode of the organic light emitting diode is electrically coupled to the drain of the first thin film transistor and the drain of the fourth thin film transistor, and a cathode of the organic light emitting diode is electrically coupled to a power source negative voltage;

wherein the drain of the second thin film transistor and the source of the third thin film transistor are both electrically shorted to the second end of the first capacitor and wherein the second thin film transistor and the third thin film transistor are respectively controlled by the current-row scan signal and the next-row scan signal to supply the data signal and the reference voltage to the second end of the first capacitor at different time periods that are separated by a time interval therebetween;

wherein the reference voltage is a constant voltage;

wherein all of the first thin film transistor, the second thin film transistor, the third thin film transistor and the fourth thin film transistor are Low Temperature Poly-silicon thin film transistors, oxide semiconductor thin film transistors or amorphous silicon thin film transistors.

10. The active matrix organic light emitting display pixel driving circuit according to claim 9, wherein the current-row scan signal and the next-row scan signal are each a pulse signal having a falling edge and a rising edge, and the falling edge of the next-row scan signal is later than the rising edge of the current-row scan signal.

11. The active matrix organic light emitting display pixel driving circuit according to claim 10, wherein the current-row scan signal and the next-row scan signal are combined with each other to provide a threshold voltage sensing stage, a holding stage, a programming stage and a drive stage one after another;

in the threshold voltage sensing stage, the current-row scan signal is a low voltage level, and the next-row scan signal is a high voltage level;

in the holding stage, the current-row scan signal is a high voltage level, and the next-row scan signal is a high voltage level;

in the programming stage, the current-row scan signal is a high voltage level, and the next-row scan signal is a low voltage level;

in the drive stage, the current-row scan signal is a high voltage level, and the next-row scan signal is a high voltage level.

* * * * *